US006039052A

United States Patent [19]

Choi

[11] Patent Number: 6,039,052

[45] Date of Patent: Mar. 21, 2000

[54] COSMETIC BRUSH ASSEMBLY

[76] Inventor: Man Su Choi, Hyundai Apartment 301-502 Sa 2-Dong, Ansan-Shi, Kyungki-Do, Rep. of Korea

[21] Appl. No.: 09/353,446

[22] Filed: Jul. 14, 1999

[30] Foreign Application Priority Data

May 20, 1999 [KR] Rep. of Korea ..... 99-18229

[51] Int. Cl.[7] ..... A45D 44/18; A45D 40/24; A45D 40/26

[52] U.S. Cl. ..... 132/313; 132/317; 132/318; 132/320

[58] Field of Search ..... 132/313, 317, 132/318, 320, 308; 16/115; 401/102, 117; 15/167.1

[56] References Cited

U.S. PATENT DOCUMENTS

| | | | |
|---|---|---|---|
| 2,582,451 | 1/1952 | Mureau | 132/318 |
| 4,842,132 | 6/1989 | Wells | 132/313 |
| 5,339,483 | 8/1994 | Byun | 132/313 |
| 5,377,842 | 1/1995 | Sorini | 132/313 |
| 5,813,421 | 9/1998 | Wang | 132/318 |
| 5,964,226 | 10/1999 | Sobel | 132/313 |

*Primary Examiner*—John J. Wilson
*Assistant Examiner*—Robyn K. Doan
*Attorney, Agent, or Firm*—Pennie & Edmonds LLP

[57] ABSTRACT

A cosmetic brush assembly according to the invention comprises a first hollow cylindrical type casing; a second hollow cylindrical type casing having a smaller length than that of the first casing and slidably accommodating a lower portion of the first casing; a brush member slidably accommodated in the first casing. The brush member has a brush formed at upper end and a plurality of engaging pieces formed at a periphery of lower end thereof. The present invention further comprises a length-variable member having an end fixed to a center of lower surface of said brush member and a cylindrical engaging member fixed to an inner circumference of lower portion of the first casing. The engaging member has a plurality of engaging pieces formed at upper end thereof, the each engaging piece of the engaging member is capable of engaging with the each engaging piece of the brush member respectively. The present invention further comprises a fixing plate to which an other end of the length-variable member, the fixing plate is fixed to an inner circumference of lower end of the second casing.

5 Claims, 6 Drawing Sheets

COSMETIC BRUSH ASSEMBLY

BACKGROUND OF THE INVENTION

1. Field of the Invention

The present invention relates to a cosmetic brush assembly and, in particular, to a cosmetic brush assembly for increasing conveniences in usage and storage by varying its length through a simple operation.

2. Statement of Disclosure

In a conventional cosmetic brush assembly, when a woman makes up herself, she uses the cosmetic brush assembly in a condition of exposing a brush to outside after separating a cap used for protecting a brush, and stores it by combining the cap with a brush body after usage. It is preferable that the length of the cosmetic bush assembly at the time of usage is longer than that of brush assembly at the time of storage for conveniences of usage. However, it makes the construction of the conventional brush complicated and causes various difficulties in manufacture.

SUMMARY OF THE INVENTION

Therefore, the object of the present invention is to provide a cosmetic brush assembly that can be increased in its length by a simple operation and has simple construction.

A cosmetic brush assembly according to the invention comprises a first hollow cylindrical type casing; a second hollow cylindrical type casing having a smaller length than that of the first casing and slidably accommodating a lower portion of the first casing; a brush member slidably accommodated in the first casing. The brush member has a brush formed at upper end and a plurality of engaging pieces formed at a periphery of lower end thereof.

The present invention further comprises a length-variable member having an end fixed to a center of lower surface of said brush member and a cylindrical engaging member fixed to an inner circumference of lower portion of the first casing. The engaging member has a plurality of engaging pieces formed at upper end thereof, the each engaging piece of the engaging member is capable of engaging with the each engaging piece of the brush member respectively. The present invention further comprises a fixing plate to which an other end of the length-variable member, the fixing plate is fixed to an inner circumference of lower end of the second casing.

The engagement between the engaging pieces of the brush member and the engaging pieces of the engaging member and releasement of the engagement are performed according to the movement upward and downward of the second casing with respect to the first casing, and a length of the length-variable member is varied according to the movement of the second casing with respect to the first casing so that the brush of brush member is exposed from or accommodated in the first casing.

In the cosmetic brush assembly of the present invention, the engaging member has a plurality of openings formed at an outer circumference of lower portion thereof, the each opening receives a protrusion of each elastic piece so that the elastic piece is located between the engaging member and the first casing when the engaging member is accommodated into the first casing so as to prevent the movement of the engaging member with respect to the first casing.

The each engaging piece of the engaging member is extended upwardly at a periphery of upper end of engaging member and has an extension extended horizontally from an upper end thereof, and each engaging piece of the brush member is extended downward at a periphery of lower end of the brush member and has an extension extended horizontally from an lower end in a direction opposite to an extending direction of the each extension of the engaging piece. Therefore, the extension of each engaging piece of the brush member is positioned below the extension of each engaging piece of engaging member, respectively, when said each engaging piece of said brush member and each engaging piece of engaging member are engaged from each other.

The brush assembly comprises a plurality elastic sheets, the each elastic sheet is inserted and fixed to the engaging member and corresponds with an end of each extension of engaging piece of the engaging member.

The length-variable member used in the present invention consists of two or more unit members. The each unit member is capable of accommodating into adjacent unit member so that a length of the length-variable member can be varied. The each unit member has recess formed in a direction of entire length at same position to each other so that the recess is superposed on a recess of adjacent unit member. Therefore, a separately rotation of the each unit member is not occurred when external force is applied to any end of the lengthvariable member.

BRIEF DESCRIPTION OF THE DRAWINGS

The above objects and other advantages of the present invention will become more apparent by describing in detail the preferred embodiment of the present invention with reference to the attached drawings in which.

Similar reference characters refer to similar parts in the several views of the drawings.

DETAILED DESCRIPTION OF THE INVENTION

The present invention will be described in detail below with reference to the accompanying drawings.

Figure 1:
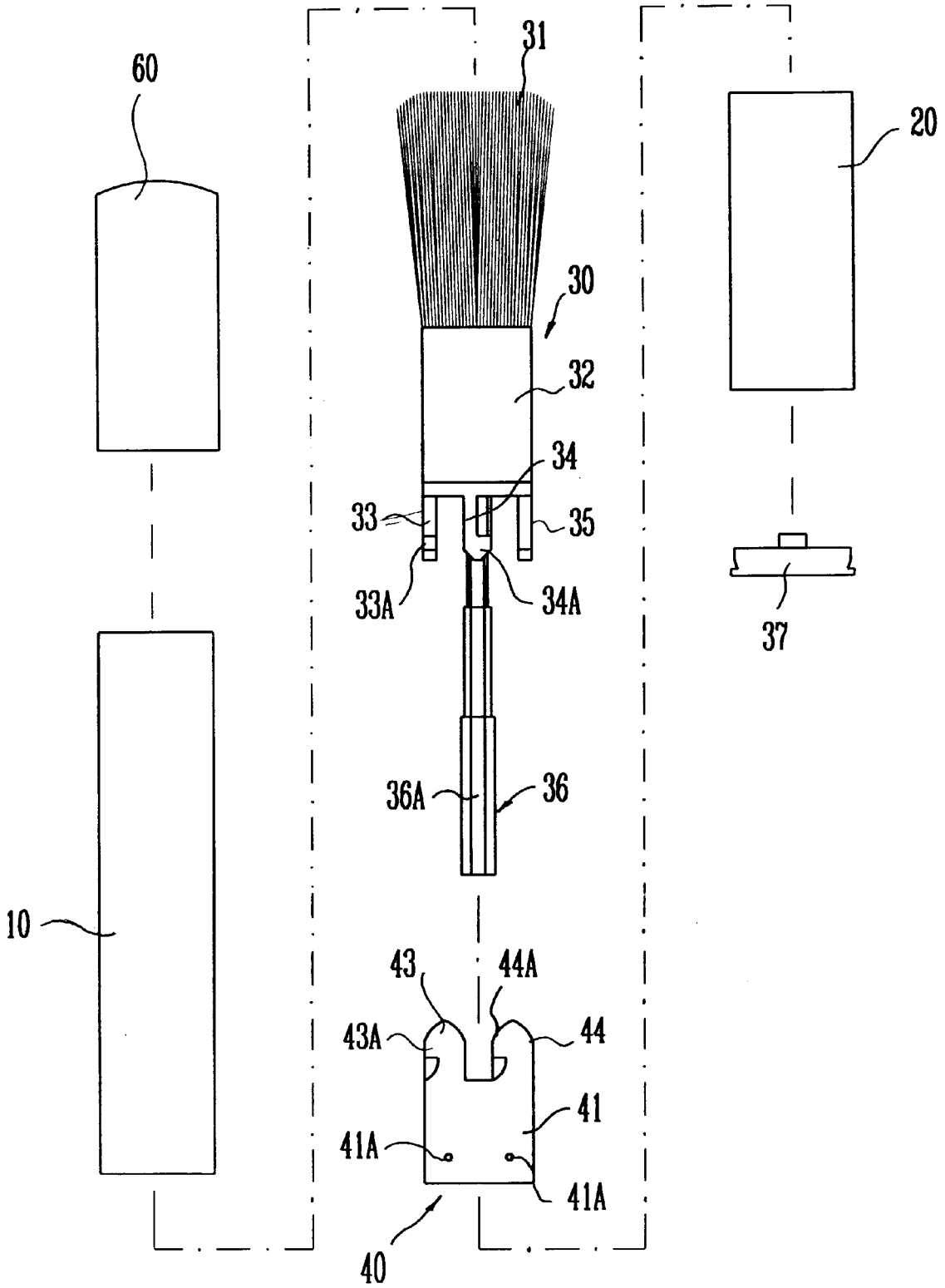
FIG. 1 is an exploded perspective view showing members consisting the present invention.

FIG. 1 is an exploded view showing members consisting the present invention. The present invention comprises a first casing 10, a second casing 20, a brush member 30 positioned in the first casing 10, and an engaging member 40. In addition, the present invention further comprises a cap 60 for protecting a brush 31 of the brush member 30 at the time of storage. The construction of each member will be described with reference to FIG. 1 and FIG. 2 which is a view showing the assembled members.

The first and second casings 10 and 20

The first and second casings 10 and 20 are hollow cylindrical type members, a length of the second casing 20 is approximately a half of the length of the first casing 10, and the first casing 10 is slidably accommodated in the second casing 20

Brush member 30

The brush member 30 slidably accommodated in the first casing 10 comprises a cylindrical body 32, a brush 31 formed at upper end of the body 32, a length-variable member 36 having an end fixed to a lower end of the body 32, and a fixing plate 37 fixed to other end of the length-variable member 36.

The cylindrical type body 32 is slidably positioned in the first casing 10 and the brush 31 is fixed on an upper end of the body 32. A plurality of engaging pieces 33, 34 and 35 having a constant length are fixed on a periphery of bottom surface of the body 32(in FIG. 1, only three engaging pieces are shown, however, the present embodiment has 4(four) engaging pieces, and they are not limited to that number), and the each engaging piece 33, 34 and 35 is provided with a extension 33A, 34A extended in horizontal direction from a lower end of the each engaging piece. All of the extensions 33A and 34A are formed in an identical direction.

At a center of the bottom of the body 32 is fixed an end of a length-variable member 36, which is increased in its length when an external force is applied to both ends thereof. The length-variable 36 is constructed in a same principle as a conventional antenna, an explanation of which is thus omitted.

Other end of the length-variable member 36 is fixed at a center of a disc type fixing plate 37, an outer circumference of the fixing plate 37 is fixed to an inner circumference of lower end of the second casing 20.

Egilg member 40 The engaging member 40 comprises a hollow cylindrical body 41 and a plurality of engaging pieces 43 and 44 formed on an upper end of the body 41. The number of engaging pieces 43, 44 of the engaging member 40 is same as that of the engaging pieces 33, 34 and 35 of the brush member 30. However, only two of them are shown in FIG. 1.

The body 41 of the engaging member 40 is fixed to an inner circumference of lower portion of the first casing 10 and the length-variable member 36 fixed to the brush member 30 is positioned within the body 41. At periphery of the upper end of the body 41 are formed a plurality of engaging pieces 43, 44 with a constant spacing, which are extended upwardly in vertical direction. In FIG. 1, only two engaging pieces 43, 44 are shown, however, the present embodiment comprises 4(four) engaging pieces, and they are not limited to that number.

On top of each engaging piece 43, 44 is formed a horizontally extended extension 43A, 44A, all of which are formed in one identical direction. On the other hand, an extending direction of the extensions 43A, 44A formed at the engaging piece 43, 44 of the engaging member 40 is opposite to an extending direction of the extensions 33A, 34A formed at the engaging piece 33, 34 and 35 of the brush member 30.

On the outer circumference surface of lower portion of the body 41 of the engaging member 40 are formed a plurality of openings (or recesses) 41A which receive a plurality of protrusions of an elastic piece to be described later, respectively.

A procedure of usage of the present invention consisting of the members described above will be described with reference to the drawings.

Figure 2:
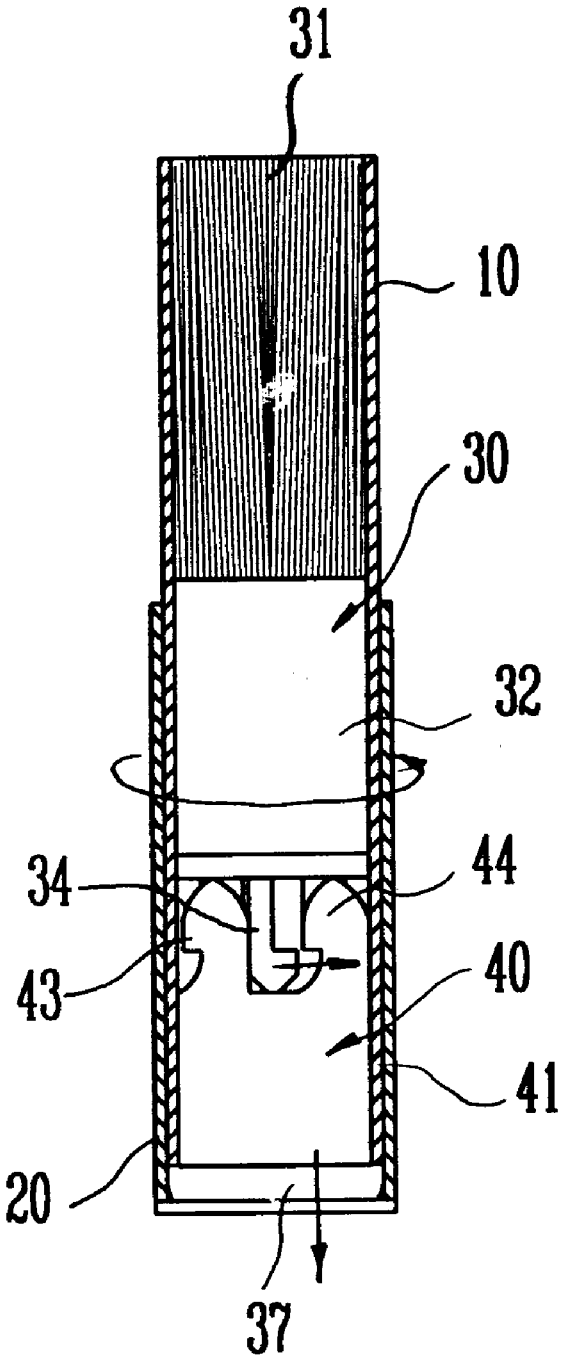
FIG. 2 is a sectional view showing the assembled member, in which a cap is not shown for conveniences and a first and second casings are in section view.
Figure 3:
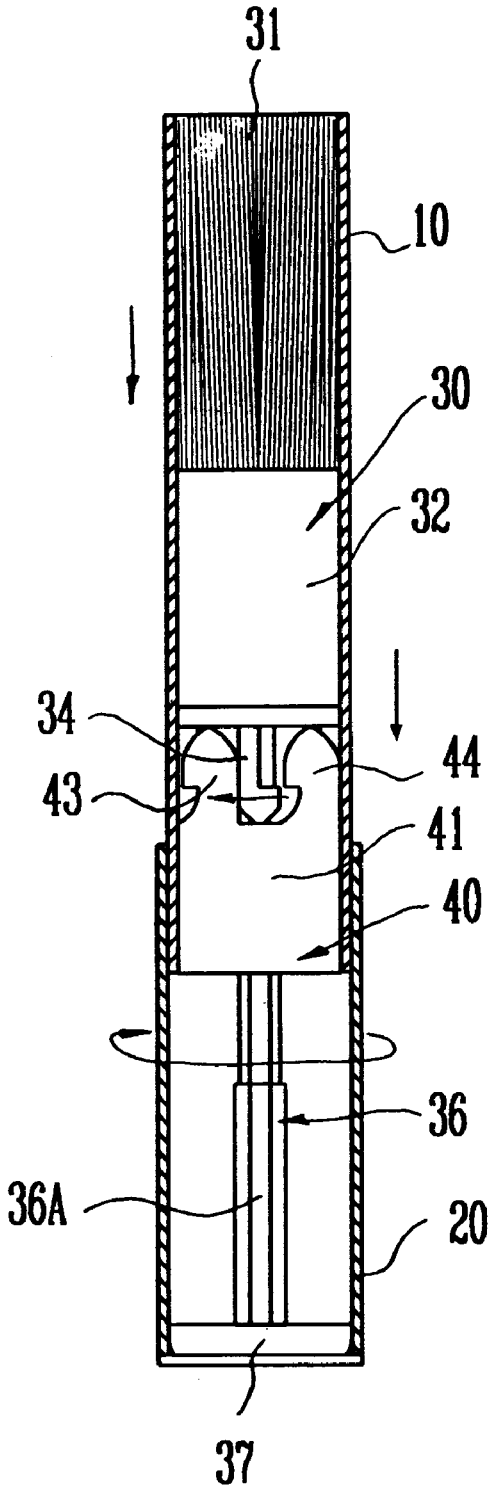
FIG. 3 is a drawing showing a condition in which the first casing is moved upwards for use from the condition of FIG. 2, the first and second casings being shown in sectional view.
Figure 4:
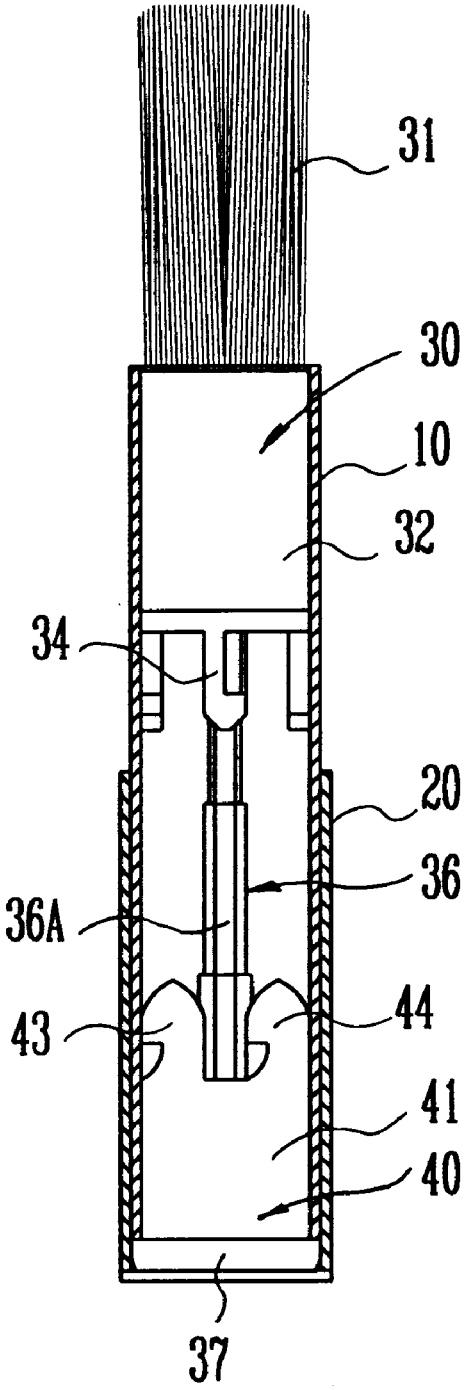
FIG. 4 is a drawing showing a condition, in use, in which members are assembled, the first and second casings being shown in sectional view.

FIG. 2 shows a condition before use, FIG. 3 shows a condition in which the first casing is upwardly moved for usage in the condition of FIG. 2, and FIG. 4 shows a condition of usage. For convenience, the first and second casings 10 and 20 are shown in section.

The condition of not using the cosmetic brush assembly, that is, the initial stage of the cosmetic brush assembly will be described. The description of the cap will be omitted since the cap 60 in FIG. 1 is simply combined with the first casing 10.

In the initial condition, that is, the condition of FIG. 2, the lower part of the first casing 10 is accommodated in the second casing 20, and the lower end of the first casing 10 contacts with the fixing plate 37 fixed to the second casing 20. Of course, the body 41 of the engaging member 40 is fixed to an inner circumference of the lower portion of the first casing 10, and the fixing plate 37 to which the lower end of the length-variable member 36(can not be seen due to the existence of the engaging member 41 in FIG. 2) is fixed is fixed to inner circumference of the lower end of the second casing 20. The length-variable member 36 of the brush member 30 is in a condition in which the length of the member 36 is minimized, therefore, the brush member 30 is completely accommodated within the first casing 10, that is, the brush 31 is not exposed to outside.

In addition, in the initial condition in which the length of the length-variable member is minimized, each of the engaging piece 33, 34 and 35(For convenience, only one engaging piece 34 is shown in FIG. 2) is positioned in a space formed by the two engaging piece 43 and 44 of the engaging member 40.

To expose the brush 31 of the brush member 30 to the outside of the first casing 10 for make-up, if a user rotates the second casing 20 about the first casing 10 in one direction (in the right direction in FIG. 2, and the direction varies according to the extending direction of the extensions formed on the engaging piece 33A and 43A), the length-variable member 36 fixed to the fixing plate 37 is rotated in the first casing 10 so that the body 32 of the brush member 30 to which the one end of the length-variable member 36 is fixed is rotated in the same direction in the first casing 10.

Figure 5:
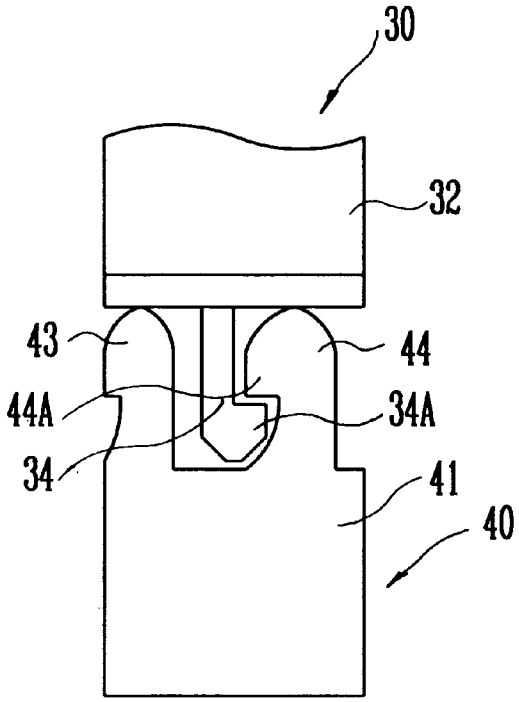
FIG. 5 is an enlarged view showing an engagement between an engaging piece of a brush member and an engaging piece of an engaging member.

Therefore, the engaging piece 34 of the brush member 30 and the engaging piece 44 of the engaging member 40 are engaged to each other, that is, the each extension 34A of each engaging piece 34 of the brush member 30 is positioned below the each extension 44A of each engaging piece 44 of the engaging member 40 as shown in FIG. 5. This action is simultaneously made in four engaging pieces, however, only one set of engaging pieces is described as an example for conveniences).

Thereafter, the user pulls the second casing 20 downward (with reference to FIG. 2) with respect to the first casing 10, with the first casing 10 grasped by the user. The second casing 20 is thus slid downward with respect to the first casing 10, and at the same time, a length of the length-variable member of the brush member 30 having an end fixed to the fixing plate 37 is increased as shown in FIG. 3.

That is, since the fixing plate 37 to which an end of the length-variable member 36 is fixed to the inner circumference of lower end of the second casing 20 and the body 41 of the engaging member 40 is fixed to the first casing 10, when the second casing 20 is moved downwardly, an external force is applied to an end of the length-variable member 36, a length of the length-variable member 36 is thus increased At this time, each engaging piece 34 of the brush member 30 and the engaging piece 44 of the engaging member 40 maintain a condition of engaging to each other, and consequently, although an external force is applied to the length-variable member 36, the brush member 30 is not moved in the first casing 10 due to the engaging member 40 fixed in the first casing 10. Therefore, the total length of the first casing 10 and the second casing 20 is increased as much as an increased length of the length-variable member 36(in the initial condition as shown in FIG. 1, since the lower ends the first casing 10 and the second casing 20 coincide, the total length of the fist casing 10 and the second casing 20 is same as the length of the first casing 10).

Thereafter, if the second casing 20 is rotated about the first casing 10 to a direction (direction of arrow of FIG. 3) opposite to the initial rotational direction, the length-variable member 36 and the body 32 of the brush member 30 fixed to the fixing plate 37 are rotated in a direction shown in FIG. 3. Consequently, the condition of engagement of each engaging piece 34 of the brush member 30 and the engaging piece 44 of the engaging member 40 is released.

In this condition, if the first casing 10 is moved downward with respect to the second casing 20, since there is a space between the body 31 of the brush member 30 and inner circumference of the first casing 10, while the body 31 of the brush member 30 maintains this condition, the engaging member 40 fixed to the first casing 10 is moved downward together with the first casing 10 so as to be separated from the brush member 30. At this time, since the length-variable member 36 which is increased in its length is positioned within the hollow cylindrical body 41 of the engaging member 40, the length-variable member 36 is not influenced by the downward movement of the engaging member 41.

Consequently, the brush 31 of the brush member 30 is exposed over the top of the first casing 10 as much as the increased length of the length-variable member 36 (condition of FIG. 4) after the downward movement of the first casing 10 is finished.

When comparing the FIG. 2 (condition before usage) and FIG. 4(condition of usage), it can be seen that the condition of the first and second casings 10 and 20 is not changed, but only the brush 31 of the brush member 30 is exposed to the outside of the first casing 10.

In FIG. 4, to restore the brush assembly to the initial condition of FIG. 1, the second casing 20 is pulled downward with respect to the first casing 10. Therefore, the second casing 20 is slid downward with respect to the first casing 10, and at the same time, the length-variable member 36 fixed to the fixing plate 37 is also moved downward. Since the body 31 of the brush member 30 to which one end of the length-variable member 36 is fixed is moved downward in the first casing 10 by the downward movement of the length-variable member 36, the brush 31 which was exposed to the outside of the first casing 10 as shown in FIG. 4 is accommodated in the first casing 10 as shown in FIG. 3. At this time, since, the first casing 10 and the engaging member 40 fixed therein maintain the state shown in FIG. 4, therefore, each engaging piece 34 of the brush member 30 which was moved downward is positioned in a space between two engaging pieces 44, 45 of the engaging member 40.

Thereafter, the second casing 20 is rotated about the first casing 10, that is, the body 32 of the brush member 30 is rotated by the length-variable 36 in the direction of arrow of FIG. 2, the body 32 of the brush member 30 is thus rotated in the direction of arrow of FIG. 2 so as to be engaged with each corresponding engaging piece 44 of the engaging member 40 so that the engaging member 40 and the body 32 of the brush member 30 are engaged. In this condition, when the second casing 20 is moved upward with resect to the first casing 10, the brush member 30 engaged with the engaging member 40 which is fixed in the first casing 10 is not moved, and at the same time, a length of the length-variable member 36 which was increased in its length is decreased by a pressure on the fixing plate 37 fixed to lower end of the second casing 20. Eventually, when a lower portion of the first casing 10 is completely accommodated in the second casing 20, all the members including the first casing 10 are returned to the condition as shown in FIG. 1 that shows a condition before usage. Thereinafter, the cap 30 is combined with an upper portion of the first casing 10.

To increase the conveniences for usage of the present invention as described above, the following additional constructions may be applied to each constitutional member.

Length-variable member 36

As described above, for engaging and disengaging of each engaging piece 34 of the brush member 30 and each engaging piece 44 of the engaging member 40, the brush member 30 must be rotated in the first casing 10, the second casing 20 must be rotated for rotating the brush member 30. When the second casing 20 is rotated, the fixing plate 37 fixed to the inner circumference of lower end of the second casing 20 and the length-variable member 36 having an end fixed to the fixing plate 37 are rotated. As a result, the body 32 of the brush member 30 to which the other end of the length-variable member 36 is fixed is rotated in the first casing 10.

The length-variable member 36 having same construction as a conventional antenna used in radio, etc. consists of two or more unit members and has the principle that its length is varied by accommodating each unit member within the adjacent unit member. However, as described above, when the length-variable member 36 is rotated, each unit member constituting the length-variable member 36 can be rotated independently with respect to the adjacent unit member. In this case, the body 32 of the brush member 30 can not be rotated. To prevent this, a recess 36A is formed in entire length direction on surface of each unit member constituting the length-variable member 36 in the present invention.

That is, when the length-variable member is in initial state in which a unit member is fully accommodated in the adjacent unit member as shown in FIG. 2 or in usage state in which a lower portion of the unit member is accommodated in the adjacent unit member as shown in FIG. 4, the recesses 36A formed on surface of the unit members are superposed to each other, Therefore, when a rotational force is applied to one end of the length-variable member 36(that is, when fixing plate 37 is rotated), a separate rotation of each unit member of the length -variable member 36 is not generated so that entire length-variable member 36 is rotated.

Engagaing member 40 and first casing 10

Figure 6:
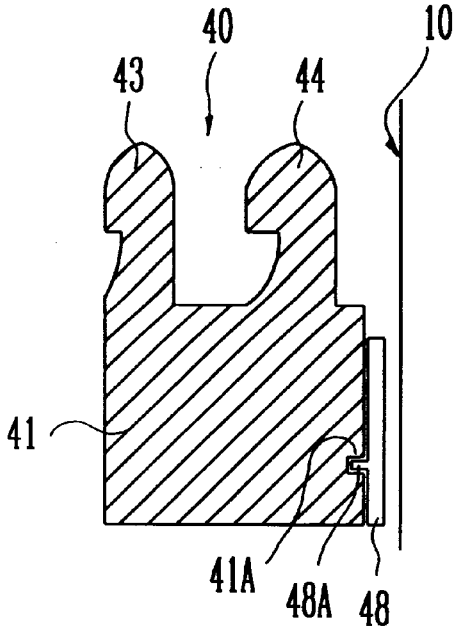
FIG. 6 is an enlarged view showing an elastic piece located between the engaging member and a first casing.

As described above, the cylindrical engaging member 40 is fixed in the first cylindrical casing 10. However, the two cylindrical members can not be integrated, therefore, the engaging member 40 is inserted in interference fit in the first casing 10. When an external force is applied to the cylindrical engaging member 40 inserted in the first casing 10, it is possible to expect that engaging member 40 be rotated. To prevent a rotation of the engaging member 40 in the first casing 10, the present invention uses an elastic piece 48 positioned between the engaging member 40 and the first casing 10 as shown in FIG. 6.

As shown in FIG. 1, at the outer circumference of lower portion of body 41 of the engaging member 40 are formed the plurality of openings 41A (or recesses), and the protrusion 48A of the elastic piece 48 is received in each opening 41A. In this condition, the engaging member 40 is inserted in interference fit in the first casing 10, the engaging member 40 is tightly fixed in the first casing 10.

Engaging member 40

As described above, to expose the brush 31 of the brush member 30 out of the first casing 10 for make-up, the user rotates the first casing 10 about the second casing 20 in one direction so that each engaging piece 34 of the brush member 30 and each engaging piece 44 of th e engaging member 40 are engaged from each other. Thereafter, the engaging condition of the engaging piece 34 of the brush member 30 and the engaging piece 44 of the engaging member 40 must be released for downward movement of the first casing 10. For this, the second casing 20 should be rotated about the first casing 10 once again in a direction opposite to the initial rotational direction.

Rotation of the second casing 20 about the first casing 10 by the user for engagement of each engaging piece 34 of the brush member 30 and each engaging piece 44 of the engaging member 40 is an essential action, however, the rotation of the second casing 20 for releasing the engaging condition of them can be removed with a simple construction.

Figure 7:
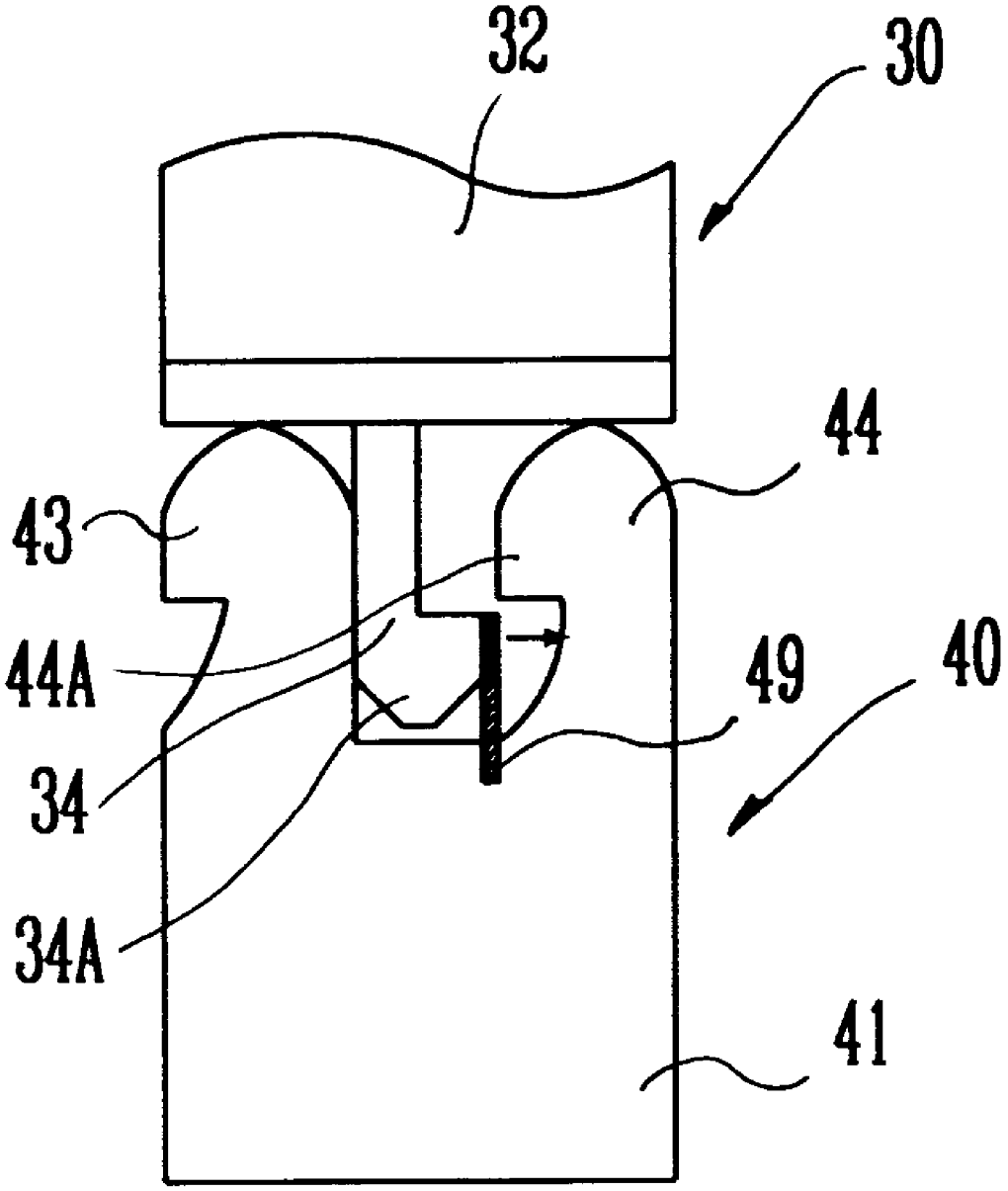
FIG. 7 is an enlarged view showing an elastic sheet fixed to an upper end of the engaging member.

As shown in FIG. 7, elastic sheets 49 are inserted and fixed vertically on portions of body 40 corresponding to ends of the extensions 44A of engaging pieces 44 of the engaging member 40, respectively. Therefore, the free end of the extension 34A of each engaging piece 34 is faced with the each elastic sheet 49.

If the user rotates the second casing 20 about the first casing 10 in one direction for the engagement between each engaging piece 34 of the brush member 30 and each engaging piece 44 of the engaging member 40, each engaging piece 34 of the brush member 30 is rotated, and the extension part 34A is positioned below the extension 44A of each engaging piece 44 of the engaging member 40 while pushing the elastic sheet 49 in the direction of arrow shown in FIG. 7 so that each engaging piece 34 of the brush member 30 and corresponding engaging piece 44 of the engaging member 40 are in the condition of engagement.

Thereafter, if the user stops the rotation of the second casing 20, the body 32 of the brush member 30 is rotated in a direction opposite to the initial rotational direction by the elasticity of the elastic sheet 49 so as to release the engagement condition. Consequently, the rotation of the second casing 20 for release of engagement between each engaging piece 34 of the brush member 30 and each engaging piece 44 of the engaging member 40 can be eliminated.

The present invention described above can expose the brush of the brush member accommodated in the first casing with simple operation and, in particular, can expose and use the brush without changing the entire length of the casing so as to expect an excellent effect of increasing the conveniences at the time of usage.

On the other hand, when the second casing 20 is moved downward from the initial condition as shown in FIG. 2, the length of the brush 31 exposed over the first casing 10 can be adjusted by adjusting the distance of movement of the second casing 20, that is, by adjusting the amount of extension of the length-variable member 36.

In the above description the cosmetic brush assembly was taken as an example, however, the same effect can be obtained by applying the present invention to a lipstick case, etc.

The foregoing description, although described in its preferred embodiment with a certain degree of particularity, is only illustrative of the principles of the present invention. It is to be understood that the present invention is not to be limited to the preferred embodiments disclosed and illustrated herein. Accordingly, all expedient variations that may be made within the scope and spirit of the present invention are to be encompassed as further embodiments of the present invention.

What is claimed is:

1. A cosmetic brush assembly having a casing, a brush member accommodated in said casing and a cap combined to said casing, comprising:

a first hollow cylindrical type casing;

a second hollow cylindrical type casing having a smaller length than that of said first casing and slidably accommodating a lower portion of said first casing;

a brush member slidably accommodated in said first casing, said brush member having a brush formed at upper end and a plurality of engaging pieces formed at a periphery of lower end thereof;

a length-variable member having an end fixed to a center of lower surface of said brush member;

a cylindrical engaging member fixed to an inner circumference of lower portion of said first casing, said engaging member having a plurality of engaging pieces formed at upper end thereof, said engaging member being engaged with said engaging pieces of said brush member respectively;

a fixing plate to which an other end of said length-variable member is fixed, said fixing plate being fixed to an inner circumference of lower end of said second casing, wherein the engagement between said engaging pieces of said brush member and said engaging pieces of said engaging member and releasement of the engagement are performed according to the movement upward and downward of said second casing with respect to said first casing, and a length of said length-variable member is varied according to the movement of said second casing with respect to said first casing so that said brush of brush member is exposed from or accommodated in said first casing.

2. The cosmetic brush assembly of claim 1, wherein said engaging member has a plurality of openings formed at an outer circumference of lower portion thereof, said each opening receives a protrusion of each elastic piece so that said elastic piece is located between said engaging member and said first casing when said engaging member is accommodated into said first casing so as to prevent the movement of said engaging member with respect to said first casing.

3. The cosmetic brush assembly of claim 1, wherein each engaging piece of said engaging member is extended upwardly at a periphery of upper end of engaging member and has an extension extended horizontally from an upper end thereof, and each engaging piece of said brush member is extended downward at a periphery of lower end of said brush member and has an extension extended horizontally from an lower end in a direction opposite to an extending direction of said each extension of said engaging piece so that said extension of each engaging piece of said brush member is positioned below said extension of each engaging piece of engaging member, respectively, when said each engaging piece of said brush member and each engaging piece of engaging member are engaged from each other.

4. The cosmetic brush assembly of claim 3, wherein said brush assembly further comprises a plurality elastic sheets, said each elastic sheet is inserted and fixed to said engaging member and corresponds with an end of each extension of engaging piece of said engaging member.

5. The cosmetic brush assembly of claim 1, wherein said length-variable member consists of two or more unit members, said each unit member is capable of accommodating into adjacent unit member so that a length of said length-variable member can be varied, said each unit member has recess formed in a direction of entire length at same position to each other so that said recess is superposed on an recess of adjacent unit member and a separately rotation of said each unit member is not occurred when external force is applied to any end of said length-variable member.

* * * * *